United States Patent [19]

Sanders

[11] 4,372,596

[45] Feb. 8, 1983

[54] FIREPLACE LOG SEPARATOR

[76] Inventor: Frank Sanders, 204 Springcreek Dr., Pineville, La. 71360

[21] Appl. No.: 223,021

[22] Filed: Jan. 6, 1981

[51] Int. Cl.[3] ..... F23H 17/10

[52] U.S. Cl. ..... 294/9; 126/25 B; 126/120; 254/104

[58] Field of Search ..... 294/1 R, 2, 9, 10, 12, 294/14, 19 R, 24; 126/25 B, 120, 152 R, 152 B, 163 R, 163 A, 164, 165, 279, 298; 254/104

[56] References Cited

U.S. PATENT DOCUMENTS

| | | | |
|---|---|---|---|
| 153,009 | 7/1874 | Nesbitt | 254/104 |
| 273,106 | 2/1883 | Kilshaw | 126/163 A |
| 1,059,019 | 4/1913 | Anthony | 126/25 B X |
| 1,128,358 | 2/1915 | Peake | 126/298 X |
| 1,192,719 | 7/1916 | Wells | 254/104 |
| 1,356,413 | 10/1920 | Staub | 254/104 |
| 2,871,848 | 2/1959 | Wall et al. | 254/104 X |
| 3,612,034 | 10/1971 | Wood et al. | 126/165 |
| 3,682,158 | 8/1972 | Thomas | 126/165 |
| 4,271,817 | 6/1981 | Thompson | 126/298 |

*Primary Examiner*—Johnny D. Cherry
*Attorney, Agent, or Firm*—Eric P. Schellin

[57] ABSTRACT

There is disclosed a wedge and a T-shaped placement tool therefor. The wedge is used to separate logs placed in a fireplace or stove, thereby improving the flow of air around them and facilitating their burning. The placement tool can be locked to the wedge by a locking means after insertion thereinto, whereupon once the wedge is properly positioned the placement tool can be disengaged. When removal of the wedge from between the logs is desired, a hook member provided on the placement tool can be hooked through a loop provided on the rearwardly extending surface of the wedge.

9 Claims, 6 Drawing Figures

FIREPLACE LOG SEPARATOR

BACKGROUND OF THE INVENTION

This invention relates to a system which involves the use of a T-shaped placement tool to place, reposition and remove a series of wedges from between logs placed in a fireplace or stove. The wedge elements serve to effectively raise and separate the logs, thus providing for greater flow of air and more oxygen to improve the burning of the logs. In this manner, the fire can circulate freely around and through the stacked logs, thus aiding combustion and providing a hotter fire for heating purposes.

The placement tool and wedge combination is cheaper and more versatile to use in comparison to previous attempts to improve a fireplace grate which provides oxygen to the logs under various conditions. These grates are often bulky and heavy so that removal of them from the fireplace can be cumbersome. Due to ash buildup in the fireplace or stove it becomes necessary to remove the grate from time to time for cleaning purposes.

The wedge provides a unique and efficient concept to building fires e.g., separation of logs. All previous concepts are built around the assumption that the logs need to be properly stacked in some particular configuration. But this always results in logs being interlocked together, which inhibits the introduction and flow of oxygen through the stacked logs as the result of the effects of gravity. The wedge allows variation in building a fire so that different types and grades of logs can be used.

The wedge allows combustion of a greater amount of escaping gases emitted from the heated logs by supplying a greater amount of oxygen to the fire. It is commonly known that combustible gases continuously escape from burning logs. However, much of the gas is not ignited due to the obvious lack of oxygen at the critical point where the gases accumulated, namely, above the stack of logs. The gases are naturally being pulled up by convection currents. All available oxygen has already been consumed before any can reach the previously stated location. By providing separation, more oxygen can reach the available gases to encourage combustion.

SUMMARY OF THE INVENTION

The object of the invention is to increase the flow of air around logs in a fireplace through the use of a series of wedges which are inserted, repositioned and removed from between the logs by means of a T-shaped placement tool.

Each wedge consists of four fins being positioned at 90 degree intervals around a central portion. The top of the wedge is provided with a locking detent and a loop formed of metal.

The placement tool consists of a handle section connected to the upper end of a shaft section whereas a pair of protrusions and a hook are attached to the lower end of the shaft portion.

The end of the shaft having the protrusions can be inserted into the locking detent of the wedge and rotated 90 degrees so that the protrusions are secured within the detent. At this time, the placement tool is interlocked with the wedge for insertion or repositioning of the wedge. Once the wedge is properly positioned the placement tool can be rotated 90 degrees so that the protrusions are free to be pulled out from the locking detent. At the time for removal of the wedge from between the logs the hook on the placement tool can be inserted through the loop on the wedge so that the wedge can then be pulled free of the logs.

BRIEF DESCRIPTION OF DRAWING FIGURES

DETAILED DESCRIPTION OF THE PREFERRED EMBODIMENT

Figure 1:
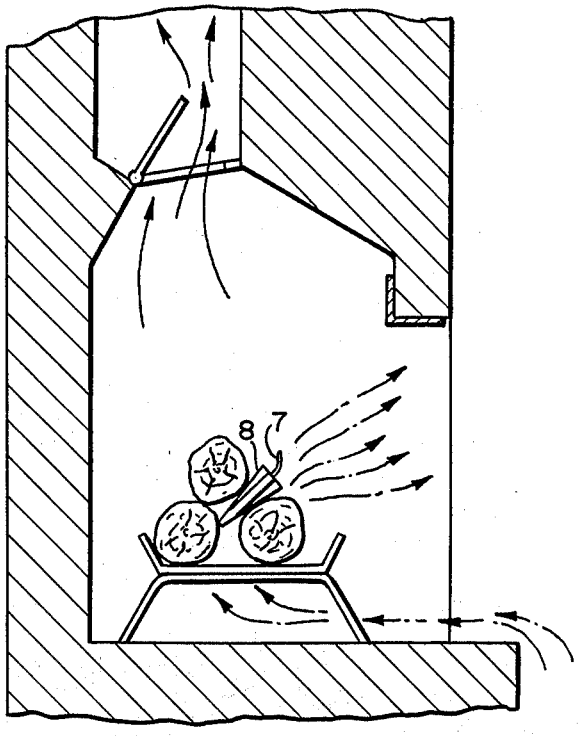
FIG. 1 is a vertical sectional view thru a typical fireplace showing the use of the invention.

Referring now to the drawings and in particular to FIG. 1 a wedge 8 is shown as it would be typically used to separate a pair of logs in a fireplace. The separation between the logs allow air to circulate therethrough resulting in a hotter fire. The air circulates due to convection currents so that cooler air is drawn in from a room outside the fireplace up through the separation between the logs. This heated air can be drawn back into the room or allowed to escape up the chimney.

Figure 2:
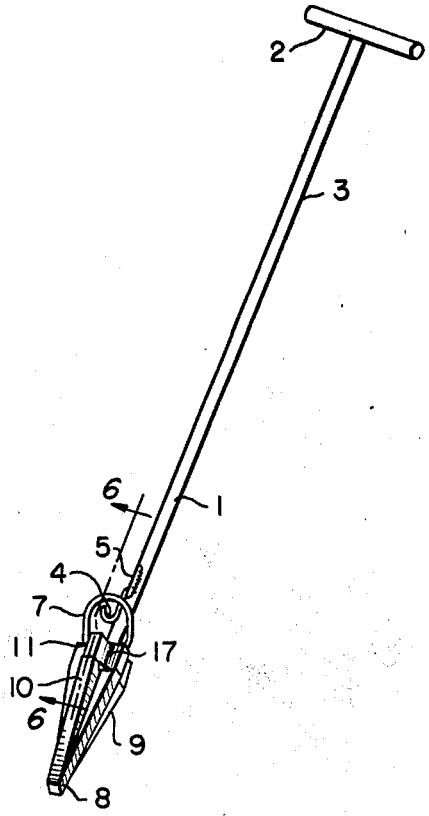
FIG. 2 is a perspective view of the wedge positioned on the T-shaped placement tool.
Figure 3:
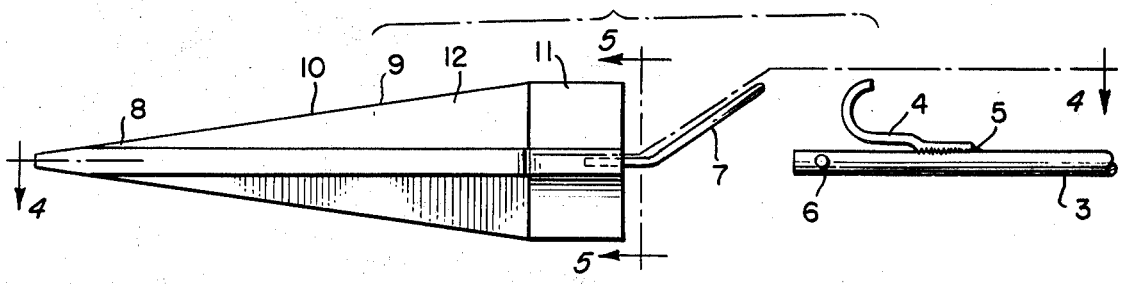
FIG. 3 is a side view of the wedge with the lower end of the T-shaped placement tool exploded therefrom.

Turning now to FIGS. 2 and 3 a perspective view of wedge 8 positioned on T-shaped placement tool 1 and a side view of the wedge 8 with the lower end of placement tool 1 exploded therefrom are presented respectively. The placement tool 1 comprises a handle section 2, a shaft section 3, a pair of protrusions 6 and a hook 4. The handle section 2 is perpendicularly attached to the upper end of the shaft section 3. The handle section 2 can be made of a variety of materials such as wood, metal or plastic. The shaft section 3 consists of a tubular piece of cast metal.

The protrusions 6 are located near the lower end of the shaft section 3 and they extend on a common plane outwardly from opposite sides of the shaft section 3. A hook 4 is attached to the shaft section 3 at 5 which is near the lower end of the shaft section 3 but farther away from the lower end than where the protrusions 6 are positioned.

The wedge 8 is comprised of four fins 9 being positioned at 90 degree intervals around a central portion 17. Each fin consists of a tapering edge portion 10 which progressively widens and then levels off towards the top of the wedge 8 into a straight edge portion 11 so that the four straight edge portions define equispaced chords. Each fin has a pair of parallel face portions 12 which extend downwardly from each side of the edge portions 10 & 11 to join with the central portion 17. The faces 12 of two adjacent fins 9 meet at a 90 degree angle at the central portion.

Figure 4:
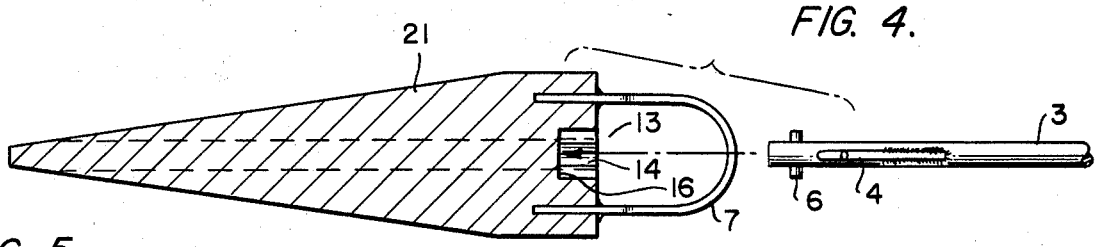
FIG. 4 is a cross-sectional view taken along line 4—4 of FIG. 3.

As shown in FIGS. 3 and 4 a U-shaped loop 7, whose ends are embedded through upper surfaces 18 into core 21 of two opposing fins 9, extends upwardly from the wedge. The ends of the loop are located on either side of locking detent 13 which is located on the upper surface of the central portion 17. The loop 7 is bent off-center so that it does not lie in a common plane with the axis of the wedge. Due to the offset in the loop 7, it does not interfere with the insertion of the placement tool 1 into the locking detent 13.

The locking detent 13 comprises an inner radially disposed cylindrical chamber 16, an axially disposed central bore 14 connecting said chamber with the outside and two radially and oppositely extending grooves 15 along said bore. The grooves 15 are adapted and constructed to accommodate the protrusions 6 as the placement tool 1 is inserted into the locking detent 13. When the placement tool 1 is fully inserted the protrusions 6 will reside within the inner chamber 16 while the shaft section 3 will be located in the central bore 14 of the locking detent 13. To effect locking, the placement tool 1 is rotated 90 degrees to effect a conventional bayonet connection. The protrusions 6 are temporarily secured within the inner chamber 16 so as to connect the placement tool 1 to the wedge 8.

While in the foregoing, it should be appreciated that reference is had to all the drawings, special clarity may be garnered from a detailed consideration of the drawings.

FIG. 4, which is a cross-sectional view, shows the locking detent 3 with the central channel 14 and the slots 15 into which the shaft section 13 and protrusions 6 are inserted.

Figure 6:
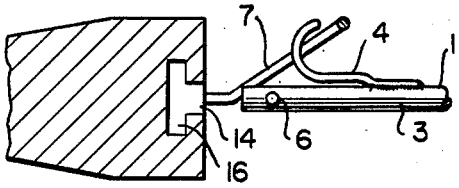
FIG. 6 is a cross-sectional view taken along line 6—6 of FIG. 2.

FIG. 6, which is a cross-sectional view, shows the central channel 14 of the locking detent 13 as defined by the upper surface of the central portion 19.

Figure 5:
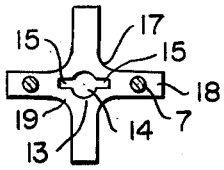
FIG. 5 is an end view of the wedge along line 5—5 of FIG. 3.

FIG. 5 is an end view of the wedge which delineates firstly, the two points at which the loop 7 meet the upper surface of two opposing fins 18 and secondly, the lock detent 13 of which the central bore 14 and the pair of grooves 15 are visible.

To reposition the wedge the placement tool 1 is inserted into the wedge 8 so that the protrusions 6 slide along the grooves 15 until the protrusions 6 are within the inner chamber 16. At this point the placement tool 1 is rotated 90 degrees so that the tool locks in bayonet fashion to the wedge. To disengage, the placement tool 1 is rotated 90 degrees until the protrusions 6 line up with the slots 15 so that the tool may be freed of the wedge.

Desirably the wedge 8 may be removed from the fireplace by the hook 4 on the placement tool 1 which may be inserted through the loop 7 on the wedge 8. The wedge may be pulled out from its location.

I claim:

1. A system for separating combustable materials when said materials are positioned in a combusting situs comprising a substantially pyramidally shaped wedge, said wedge having a bore portion, said bore portion having an internally disposed chamber, a keyway communicating said chamber and externally of said bore portion, an elongated carrying means for said wedge, said carrying means having a handle means at one end portion, said carrying means having means at the other end portion adapted and constructed to pass through said keyway into said chamber whereby when said carrying means is rotated said wedge and said carrying means are locked together.

2. The system of claim 1 wherein the bore portion has extending therefrom a loop and said carrying means has at substantially the other end portion from said handle means a hook adapted and constructed to be in operating relationship with said loop.

3. The system of claim 1 wherein the keyway and the means at the other end portion of the carrying means comprise a bayonet connection.

4. The system of claim 3 wherein the chamber is substantially cylindrical and is substantially axially positioned in said wedge.

5. The system of claim 4 wherein the keyway is substantially axially positioned in said wedge.

6. The system of claim 5 wherein the wedge has a plurality of equispaced ribs.

7. The system of claim 6 wherein the ribs diminish in radial dimension from the bore portion to an apex.

8. The system of claim 7 wherein the bore portion has extending therefrom a loop and said carrying means has at substantially the other end portion from said handle means a hook adapted and constructed to be in operating relationship with said loop.

9. A device for separating combustable materials when said materials are positioned in a combusting situs comprising a substantially pyramidally shaped wedge, said wedge having a bore portion, said bore portion having an internally disposed chamber, a keyway communicating said chamber and externally of said wedge through the bottom of said bore portion, said wedge having a plurality of equispaced ribs of gradually diminishing height from the bore portion to an apex of the wedge.

* * * * *